US005088919A

United States Patent [19]

De Bruyne et al.

[11] Patent Number: 5,088,919

[45] Date of Patent: Feb. 18, 1992

[54] BURNER MEMBRANE

[75] Inventors: Roger De Bruyne, Zulte; Ronny Losfeld, Waregem, both of Belgium

[73] Assignee: N. V. Bekaert S.A., Zwevegem, Belgium

[21] Appl. No.: 493,737

[22] Filed: Mar. 15, 1990

[30] Foreign Application Priority Data

Mar. 29, 1989 [BE] Belgium ..... 8900345

[51] Int. Cl.[5] ..... F23D 14/12

[52] U.S. Cl. ..... 431/328; 431/326; 126/92 AC

[58] Field of Search ..... 44/532; 126/92 AC, 92 R; 110/194, 341; 431/326, 325, 327, 328, 431

[56] References Cited

U.S. PATENT DOCUMENTS 1,731,053 10/1929 Lowe ..... 431/328
3,127,668 4/1964 Troy ..... 428/605
3,505,038 4/1970 Luksch et al. ..... 428/605
4,094,673 6/1978 Erickson et al. ..... 420/62
4,139,376 2/1979 Erickson et al. ..... 420/62
4,485,584 12/1984 Raulerson et al. ..... 44/532

FOREIGN PATENT DOCUMENTS 0157432 9/1985 European Pat. Off. .

*Primary Examiner*—Margaret B. Medley
*Attorney, Agent, or Firm*—Nixon & Vanderhye

[57] ABSTRACT

The invention relates to a burner membrane (1) for radiant burner comprising a porous sintered web of inorganic fibres that are resistant to high temperatures, wherein at least the membrane surface (3) opposite from the fuel supply side (2) has been provided with grooves (4) in the shape of a grid and which grooves bound the meshes (5) of the grid. Preferably, the meshes are regular polygons with a surface area of between 4 and 400 $mm^2$. The porosity is between 70% and 90% and the permeability variation over its surface is less than 25%.

26 Claims, 3 Drawing Sheets

FIG. 8a
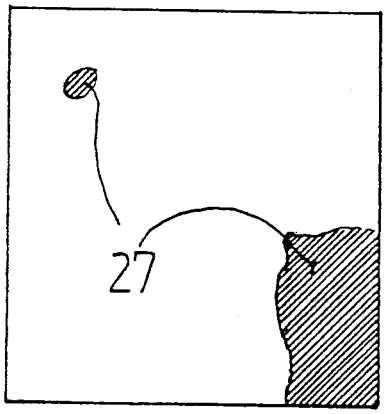
FIG. 8b
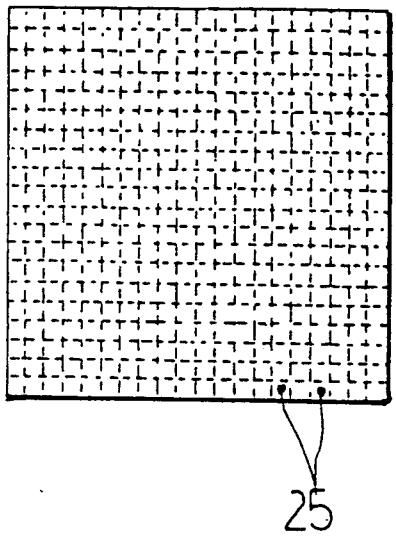
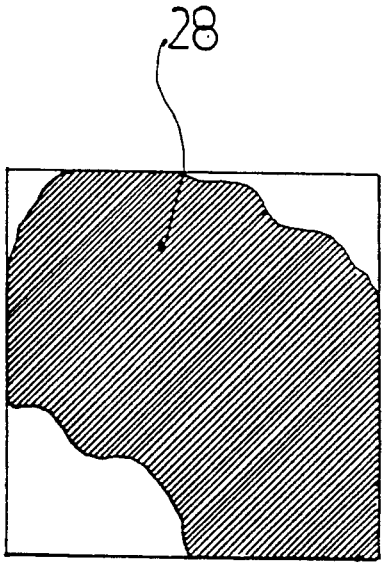
FIG. 9a
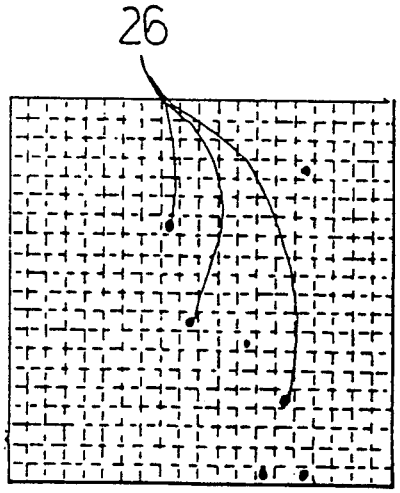
FIG. 9b

BURNER MEMBRANE

FIELD OF INVENTION

The invention relates to a porous burner membrane for radiant burners, which membrane contains sintered metal fiber webs.

BACKGROUND AND SUMMARY OF THE INVENTION

Burner membranes containing sintered metal fiber webs are known from European patent application 0157432. The metal fibers used in accordance with this application are resistant to high temperatures.

Repeated use of these membranes causes the radiant sides of the surface layers to be subjected to very strong temperature fluctuations that vary from room temperature to possibly 1000° C. These surface zones are thereby alternately subjected to strong thermal expansions and contractions. Irregularities in the porosity of that surface result in local temperature differences and therefore in mechanical stresses. The zones with the lowest porosity heat up the most. In the course of time (i.e. after having been subjected to a considerable number of cold/hot temperature cycles), this can occasion the formation of small checks (fissures), cracks or craters in the membrane surface.

Porosity increases at these cracks so that preferential channels are formed for fuel flow. This causes the formation of a blue flame, which must be avoided in the case of radiant burners (because a blue flame results in higher $NO_x$ emission). Besides, the blue flame formed has the tendency to further extend the crater or crack zone. Indeed, the very high flame temperature attacks the small crater walls further and attack deeper under the membrane surface (in the opposite direction of the gas supply), for instance by locally melting together the crater edge fibers there.

It is now the object of the invention to avoid these drawbacks and to counter degeneration, i.e. the formation of small craters or cracks during the use of the membrane.

In particular, it is the object of the invention to avoid these drawbacks in the case of radiant membranes the porosity of which is not completely uniform over their surface and/or through the thickness of their surface layer.

It is therefore an object of the invention to provide burner membranes for radiant burners, which membranes comprise, at least near their radiant surface, porous sintered fiber webs of inorganic fibers that are resistant to high temperature and with an enhanced resistance to degeneration due to temperature fluctuations, i.e. with a higher durability.

It is a further object of the invention to provide radiant burner membranes of sintered fiber webs which, despite a maybe less uniform porosity near their radiant surface, show a strongly reduced tendency to form blue flames, particularly after a longer time of use.

It is also the object of the invention to provide burner membranes whereby the extension of any small craters formed is strongly contained during further use, so that a further degeneration is stopped.

It is yet another object of the invention to provide burner membranes with a higher, more uniform and more durable heat radiation power and lower $NO_x$ emission, by containing crater formation and blue-flame formation.

Yet a further object of the invention deals with the provision of a radiant surface combustion burner comprising a housing with inlet means for the fuel supply and a burner membrane as herein further described at its outlet combustion side.

Finally it is an object of the invention to provide a process for radiant heating articles with increased efficiency, whereby the articles are disposed in front of the radiation side of a burner membrane according to the invention.

In particular, it is the object of the invention to provide sintered fiber-web membranes with a reduced tendency to degenerate, which have an average porosity of from 70 to 90% and preferably of from 77 to 85%. Moreover, the variation in permeability P (as defined hereinafter) from one place to another over the sintered sheet will preferably be lower than 25% and most preferably even lower than 10%. These membranes may be made in a flat, bent or cylindrical shape, as desired.

These objects are met in accordance with the invention by making grooves in the shape of a grid, at least into the membrane surface opposite from the fuel supply side: i.e. the surface at the radiant side. This precludes an uncontrolled formation and extension of these local cracks, if any, over the surface. Indeed, the grooves constitute barriers to the further proliferation of crack formation. Moreover, the grooves divide the surface into a kind of small waffles that can expand (and contract) in random directions parallel to the membrane surface, the small grooves growing narrower as temperature increases, or wider as the membrane cools down. Consequently, the temperature cycles then cause less local mechanical stresses in the membrane surface. So, the risk that cracks will be formed in the course of time is strongly reduced.

A sintered fiber membrane sheet in accordance with the invention generally has a thickness of about 2 to 5 mm. It is only an approximately 1 mm thick boundary layer on the radiant side which heats up strongly during burning. Therefore, it will be sufficient and it is indicated to make the grooves not deeper nor wider than 1.5 mm and preferably even less deep and narrower than 1 mm. Groove depths of between 7 and 15% of the total sheet thickness, e.g. about 10%, will be preferred.

On account of the intended uniformity, the groove grid preferably has meshes of nearly equal surface area. Preferably, the meshes are equal regular polygons such as equilateral triangles, squares, rhombi or regular hexagons. Their surface area is chosen between 4 $mm^2$ and 400 $mm^2$. Meshes that are smaller than 4 $mm^2$ reduce the useful burner surface too much whereas there are too few barriers against crater proliferation if the meshes are larger than 400 $mm^2$. Preferably, the mesh area is between 9 $mm^2$ and 250 $mm^2$ and most preferably between 20 $mm^2$ and 150 $mm^2$.

BRIEF DESCRIPTION OF THE ACCOMPANYING DRAWINGS

The foregoing will hereinafter be explained further with reference to the accompanying drawings, whereby further advantages will be explained.

Figure 5A:
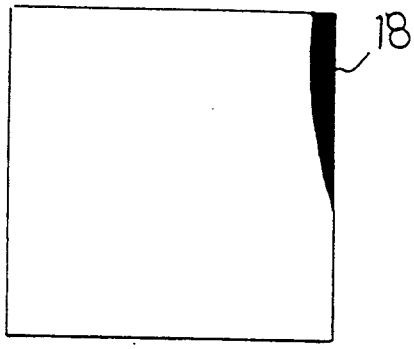
Figure 5B:
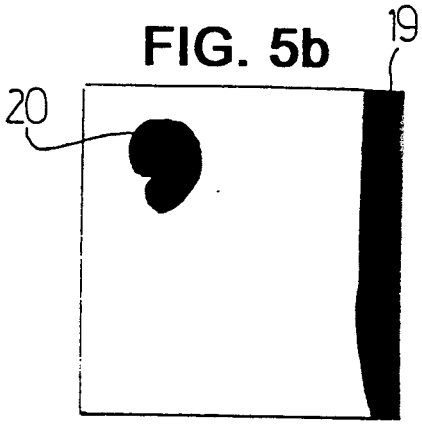

FIGS. 5(*a*) and 5(*b*) respectively show the effects of low and relatively high radiant heat powers on an ungrooved burner membrane tested in accordance with Example 1 below.

Figure 6A:
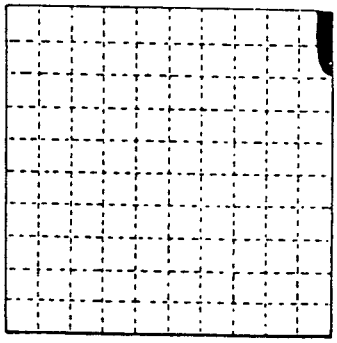
Figure 6B:
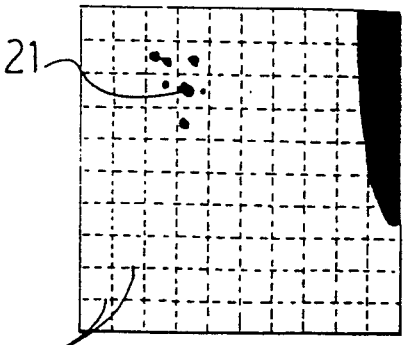

FIGS. 6(*a*) and 7(*a*) each illustrate the effects on respective different grooved burner membrane embodiments according to the present invention at a low radiant heat power as tested in accordance with Example 1 below.

FIGS. 6(*b*) and 7(*b*) each illustrate the effects on the same burner membranes as shown in FIGS. 6(*b*) and 7(*b*), respectively, but at a relatively high radiant heat power as tested in accordance with Example 1 below.

FIGS. 8(*a*) and 8(*b*) respectively show the effects on ungrooved and grooved burner membranes with lower permeability variation at relatively high radiant heat powers tested in accordance with Example 3 below.

FIGS. 9(*a*) and 9(*b*) respectively show the effects on ungrooved and grooved burner membranes similar to FIGS. 8(*a*) and 8(*b*), but tested at a very high radiant heat power in accordance with Example 2 below.

DETAILED DESCRIPTION OF THE PREFERRED EMBODIMENTS

The porous membrane sheet 1 of sintered metal fiber webs comprises at its upper surface 3 a grid that consists of a number of grooves 4 bounding a number of square grid meshes 5. The so-called meshes 5 are in fact waffle-shaped elevations in the boundary layer at the radiant side 3. The fuel is supplied at the bottom (or back side) of the sheet 1 as suggested with the arrows 2.

Figure 2:
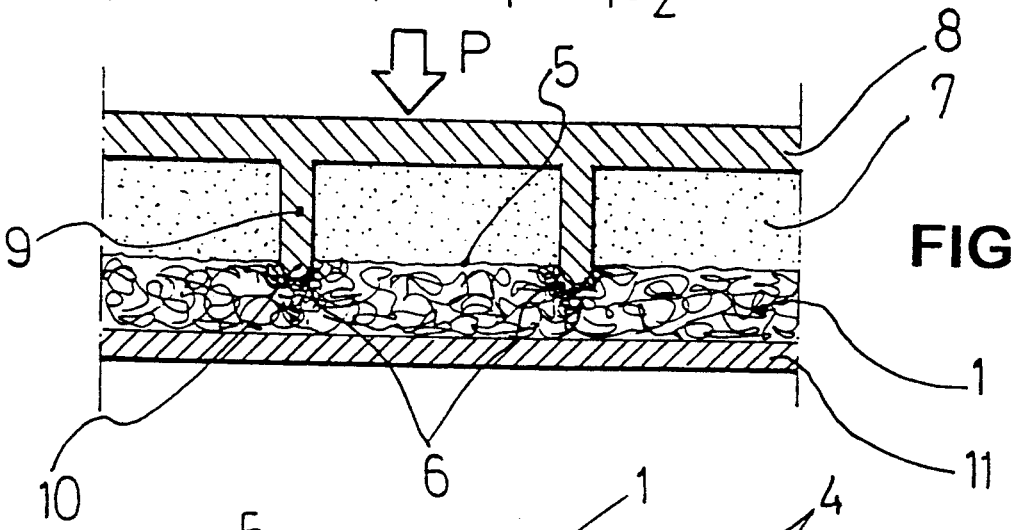
FIG. 2 is a schematic representation of means to impress grooves combined with isostatic pressing.

The grooves can be milled or etched away into the surface of the membrane. However, they can also be impressed or drawn into it with a sharp edge. The latter methods have the advantage that the porosity of the membrane in the boundary zones 6 of the grooves 4 becomes lower than outside. The impression can be effected by means of sheets or rolls provided with suitable ribs that have a shape that is complementary to that of the grooves or the groove grid. If so desired, the impression can be carried out involving application of an intermediate layer of felt so as to obtain an isostatic-pressing effect at the same time, as shown in FIG. 2. Also, round disks with relatively sharp circumferential edges that are mounted parallel on shafts can be used for the impression of the grooves.

Figure 4:
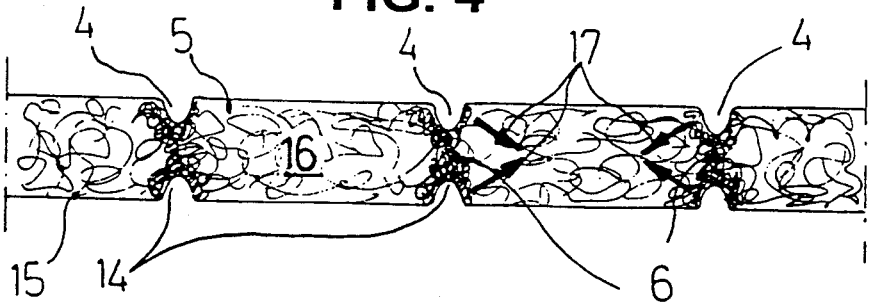
FIG. 4 shows a membrane sheet that is provided with a groove grid on both sides.

A method and means for (cold) isostatic pressing of burner membranes is in itself described in the European patent application no. 88202616.4 of the present applicant (and schematically illustrated in its FIG. 4). Analogous to this method and in accordance with the invention (FIG. 2), the porous sintered fiber mat is laid on a rigid base plate 11. A sheet 8 with suitable raised ribs 9 in accordance with the desired groove pattern or grid is pressed onto the surface of the mat However, small compressible felt blocks 7 of desired thickness have been fitted between the ribs 9 for the isostatic compression of the mat in order to form the waffles 5 between the grooves at the rib tops 10. It is of course also possible to work in two steps, pressing isostatically over the whole surface first before making grooves. Also, the small felt mat blocks and, hence, the explicitly isostatic pressing treatment can be dispensed with as this raises the cost of manufacture. Indeed, it is probable that the impression (or drawing) of the grooves causes in itself a certain isostatic pressing effect in the membrane. The pressure applied at the grooves can, indeed, propagate inwards into the membrane where it compresses the most porous zones further. This then results in a more uniform porosity through the volume of the membrane waffles 5 between the compressed waffle walls (boundary zones) 6 at the grooves 4 (see also arrows 17 in FIG. 4).

It has now been found that the grooves 4 and the adjacent compressed zones 6 form barriers near the membrane surface to cracks still formed and advancing in one waffle 5. Indeed, the crack no longer propagates through the compressed zone 6 to an adjacent waffle 5.

The nonwoven web of inorganic fibers, e.g. of metal fibers, can be made in accordance with (or similar to) the method described in the U.S. Pat. No. 3,505,038 or U.S. Pat. No. 3,127,668. After the web is formed, it is pressed and sintered in the known manner, whereby the crossing fibers stick to each other in their contact points, forming a porous and rigid fiber netting. For application as radiant burner membranes, an average porosity of between 70 and 90%, in particular of between 80 and 85%, has been found suitable. The accepted tolerance on the average value preferably is 2%, plus or minus. If desired a sintered mixture of fibers and metal powder can also be used for the membrane sheet.

As fibers with a good resistance against high temperatures, aluminium and chromium containing metal fibers are particularly suitable, especially those analogous to or corresponding to those described in the patents EP 157432 or in U.S. Pat. No. 4,139,376 or U.S. Pat. No. 4,094,673. Preferably, the fiber diameter will be less than 50 micra, in particular between 4 and 30 micra.

Before utilizing the sintered fiber mat as burner membrane for radiant combustion, it is advisable to oxidise the mat beforehand in order that a protective (inert) $Al_2O_3$ layer be formed on the fiber surfaces. This prevents reducing components, if any, in the fuel current from attacking or corroding the fibers. Nickel alloy fibers with i.e., about 16 % Cr, about 5% Al and preferably a very small amount of a rare earth element are suitable as well for membranes. It may even be envisaged to coat metal alloy fibers of simpler composition with Aluminium or aluminium compositions in view of creating the protective aluminium oxide layer afterwards. The coating can be carried out either at the fiber stage, the web stage or the sintered web stage.

Preferably, the differences in permeability from one place to another over the sintered sheet will be below 25% and most preferably even below 10%. Indeed, higher variations in permeability promote blue-flame formation. Permeability P is expressed in $m^3/m^2$, i.e. the gas flow rate straight through the sintered fiber mat with a pressure drop of 1000 Pa over the thickness of the mat. This flow rate is determined at different places (1 to n) over the surface of the mat: $P_1, P_2 \ldots P_n$. The maximum (Pmax) and minimum (Pmin) permeability value of this series of P values is noted down. The permeability variation is then determined by $[(Pmax-Pmin):Pmax]\times 100$ (%). A lower variation in permeability, both intrinsically (i.e. as a result of a more uniform porosity over the mat) and due to the driving back of crack and crater formation in accordance with the invention, results in a higher heat radiation power, for less blue flames are formed, which restrict this power. Also, $NO_x$ emission, which is coupled with blue-flame combustion, has decreased considerably. This way, the invention makes it possible to realize radiation powers of 800 KW and more per $m^2$ of radiant surface, in a lasting and durable way.

Figure 3:
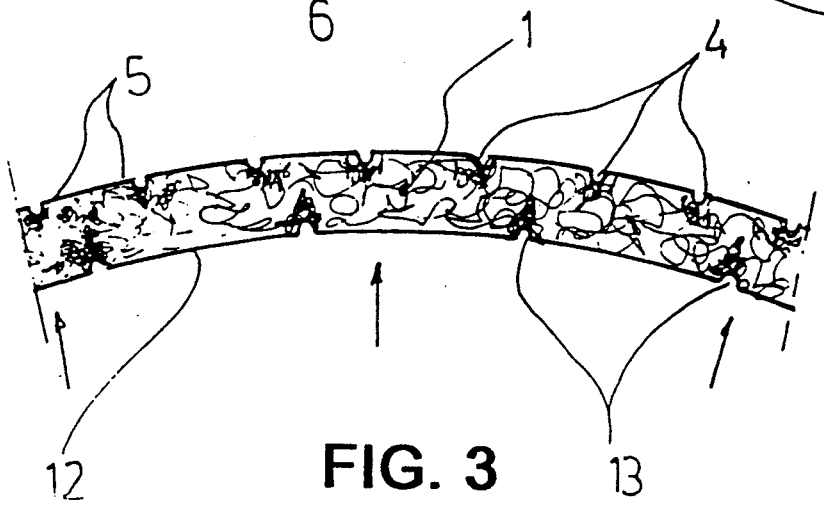
FIG. 3 is a section through a cylindrically bent membrane sheet.

If the membrane is made in the shape of a cylinder, as sketched in cross section in FIG. 3, the concave side 12 of the cylindrical membrane wall 1 will preferably also be provided with grooves 13 following the generating line of the cylinder. These grooves 13 guarantee a controllable folding action of the membrane without its porosity being disturbed at random. So, to form the cylinder one starts from a flat sheet which is folded to cylinder shape on a mandril with the desired diameter. The two longitudinal edges of the membrane sheet that have been bent into a cylinder are lap joined, be it by weld points, rivets or refractory glue points. The cylindrical burner membrane can of course also be used with its axis in a vertical position and a fuel supply to the inner space of the cylinder either in downward or upward direction.

It is also possible to provide the burner membrane with a groove grid on both sides, as shown in FIG. 4 for instance. If the groove pattern 4 on one side is then the same as the groove pattern 14 located straight opposite at the other side, one creates in fact a clear pattern of cells 16 between opposite surface waffles 5 and 15 and bounded by successive cell or waffle boundaries 6. Moreover, this embodiment brings about a certain isostatic pressing effect by facilitating pressure propagation along arrows 17, which results in a more homogeneous porosity. Besides, such a burner membrane can be successively utilized first with the waffles 5 and later with the waffles 15 at the radiant side.

Membrane sheets of a laminated structure of fiber layers of different composition can also be used. The thin surface layer (thickness less than 2.5 mm) at the radiation side of the membrane then consists of the inorganic heat resistant firers (such as FeCrAlloy-fibers). However the supporting layer at the fuel supply side can be a sintered web layer of stainless steel fibers (series AISI 300 or 400—e.g. AISI 430) or of the type Haynes, Inconel, Nimonic, Hastelloy and Nichrome. If desired, a sintered layer of a mixture of e.g. FeCrAlloy-fibers and said stainless steel type fibers can be contemplated in conformity with the teachings of EP 227,131 of applicant.

The burners can also be arranged with a downwardly directed gas supply flow through a substantially horizontally disposed membrane with its radiation surface at the underside of the membrane. The radiation efficiency is increased here (versus an upward gas flow arrangement) by the effect of a more even temperature distribution over the membrane surface and by a slight increase in the membrane temperature.

Preheating of the fuel gas mixture (or air component thereof) may also increase the radiation efficiency. A preheating to about 200° C. (and even to 300° C.) will generally increase said efficiency by about 35-70% above the efficiency reached with a cold gas mixture. At the same time $NO_x$-emissions hardly increase. It is useful to remind in this connection that such preheating is not significantly favorable for ceramic burners.

Figure 1:
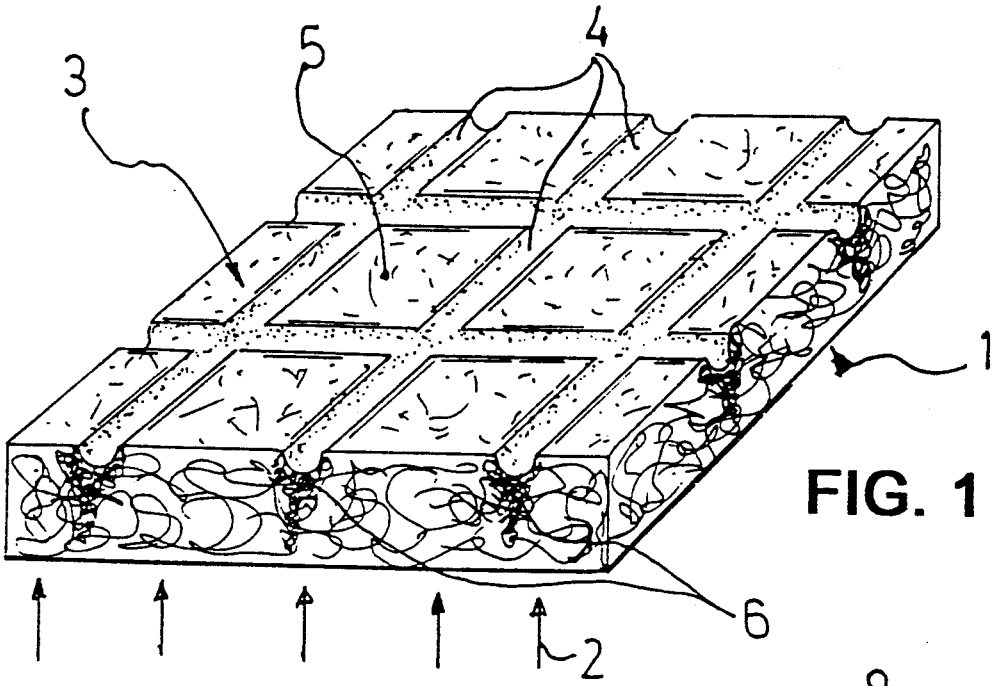
FIG. 1 is a perspective sketch of a flat membrane sheet.

In general, the radiant surface combustion burner comprises a housing with conventional inlet means for the supply of the fuel gas mixture to be burned. The mixture crosses the housing from the inlet side towards the exit or outlet side which is closed by the porous burner membrane according to the invention. The downstream outer side of the membrane is the radiant combustion surface. The membrane can be fixed to the housing by bolts as shown in EP 157,432. Preferably however the flange (4) shown in FIG. 1 of said EP 157,432 is deleted and the membrane is bolted directly onto the housing frame i.e., to increase the effective radiation surface to its potential maximum (including the membrane edges).

EXAMPLE 1

A burner membrane sheet in the shape of a square with sides of 20 cm and with a thickness of 4 mm, which consists of a sintered web of FeCrAlloy fibers (diameter: 22 um) and which had a porosity of 80.5%, was utilized in a radiant burner. The sintered web was not isostatically compacted and the permeability variation was 27%. The gas mixture, each time comprising a stoichiometric combustion mixture of air / propane bottle gas, was successively supplied at rate that resulted in a burner power of 500 KW/m² and 800 KW/$m^2$, respectively. Here and there, a blue flame appeared above the membrane.

In FIG. 5 (*a*), the black boundary zone indicates the place where a blue flame appeared at 500 KW/$m^2$. When the power was increased to 800 KW/$m^2$, this boundary zone expanded to area (19). There also appeared a blue-flame patch in zone (20) (FIG. 5(*b*)).

Then, a groove grid with square meshes with a surface area of 400 $mm^2$ each was made into to the membrane surface at the radiant side. The groove depth was 0.3 mm. The black patches in FIG. 6 correspond to the blue-flame patches appearing at 500 KW/$m^2$ (FIG. 6(*a*)) and 800 KW/$m^2$ (FIG. 6(*b*)), respectively.

Figure 7A:
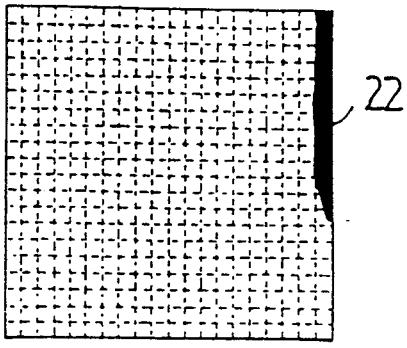
Figure 7B:
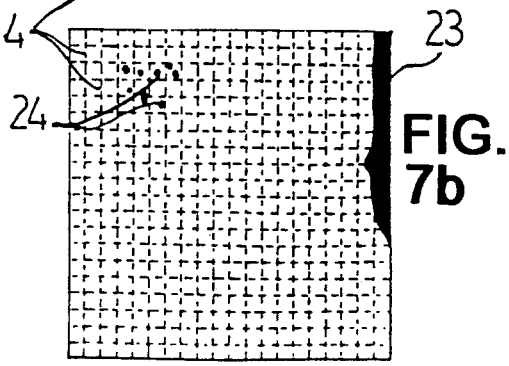

The same membrane was then provided with additional grooves at the same radiant side so as to form square meshes with a surface area of 100 $mm^2$ each. The narrow boundary zone 22 in FIG. 7 (*a*) indicates the blue-flame zone at 500 KW/$m^2$ and zone 23 in FIG. 7(*b*) its expansion at 800 KW/$m^2$. When the power is increased, the blue-flame zone generally expands, as appears from a comparison of figure parts (a) with the corresponding figure parts (b). However, the application of a groove grid clearly proves useful for containing or limiting blue-flame formation when higher powers are applied (figure parts b). This is evident from a comparison of patches 20, 21 and 24.

EXAMPLE 2

A burner membrane as in example 1, but with a permeability variation of 6% only, was tested as well. These membranes comply with a lower limit for blue-flame formation of 800 KW/$m^2$, which means that no blue-flame formation occurs at powers below 800 KW/$m^2$. An embodiment without groove grid and one with groove grid (again at one side: the radiant side) and with square waffles of 100 $mm^2$ were compared with each other at powers of 1000 KW/$m^2$ and 1100 KW/$m^2$, respectively. At 1000 KW/$m^2$ and 1100 KW/$m^2$, respectively, clearly much less blue flames appeared in the grooved mat (patches 25 and 26 in FIGS. 8(*b*) and 9(*b*), respectively) compared to the ungrooved mat: shaded patches 27 and 28 in FIGS. 8(*a*) and 9(*a*) respectively, It also clearly appears from this test that a low permeability variation has a very advantageous effect.

EXAMPLE 3

Two burner membranes, each with a porosity of 80.5% and which were isostatically compacted, had a permeability variation of 7.6%. Next, one of the membranes was provided with a groove grid as in example 2 (meshes/waffles of 100 $mm^2$). Both membranes were subjected to a long working cycle (aging test), whereby successive burning periods of 8 min. alternated with cooling intervals of 2 min. The power was set at 500 $KW/m^2$ for both membranes. Opposite the radiant surface, a reflecting ceramic fiber sheet was placed at a distance of 4 cm, as a result of which the membrane surface temperature rose by +150° C. to about 1080° C. This illustrates the significant improvement of burner membranes in practical use conditions due to back radiation (heat reflectance) of the surface to be heated. After having worked continuously under these operating conditions for 1 week, the ungrooved membrane showed small scattered checks and cracks over almost the whole membrane surface. The cracks grew further when these burning conditions were continued. No checks or cracks appeared in the grooved membrane, even after the latter had been subjected to the ageing test for several weeks.

EXAMPLE 4

A number of burner membranes as described above with a porosity of 80.5% were tested for comparison of their behaviour with respect to pressure drop ΔP during operation (combustion) and to $NO_x$-emission.

Standard membranes with thicknesses of 4 mm (A) resp. 2 mm (B) and which were not provided with a grid of grooves were compared with membranes C and D according to the invention. The membranes C were provided with a grid with square meshes (2 cm by 2 cm) whereas the membranes D with the same grid pattern had in addition been isostatically compacted (see example 3 and FIG. 2). Sample E relates to a standard membrane of 4 mm thickness without groove grid but which had been preoxidized.

The table below summarizes the results of endurance or ageing tests after some months of burning.

| | Ageing: burning time | $NO_x$ ppm (aver.) at $KW/m^2$ | | ΔP mm WC (average) at $KW/m^2$ | | BFL* $KW/m^2$ after four months of ageing | Variation Permeability |
|---|---|---|---|---|---|---|---|
| | (months) | 500 | 800 | 500 | 800 | | % |
| A | 14 | 40 | 110 | 45 | 55 | 500 | 5.6 |
| B | 12 | 40 | 115 | 19 | 22 | 400 | 11.1 |
| C | 6 | 25 | 80 | 30 | 39 | 800 | 9.2 |
| D | 10 | 27 | 75 | 25 | 35 | 750 | 8.3 |
| E | 10 | 30 | 83 | 31 | 42 | 800 | 7.6 |

*BFL means Blue Flame Limit: i.e. the power at which radiation heating turns to blue flame appearance.

From this table can be concluded that indeed the $NO_x$-emission substantially decreases with the provision of a grid of grooves in the radiation surface of the membrane. (The $NO_x$-emission is expressed with its stoichiometric values.)

It was also noted with interest that $NO_x$ and ΔP-values (in mm water column) remained much more constant with ageing time for membranes according to the invention (samples C, D and E) than for standard membranes A and B.

Finally the drastic increase of the blue flame limit for samples C, D and E confirms the increased performance and merits of the burner membrane and radiant combustion burner of the invention.

The radiant burner membranes and burners in accordance with the invention are especially suitable for heating applications where both radiant heat and convection heat play a part or where a fine temperature adjustment is required and there is no need to exceed a temperature limit of 800° C. for the surface to be heated. A useful field of application relates to drying sections in paper manufacturing processes. Also for the specific shaping, i.e. bending of glass sheets for vehicle wind screens, a preheating radiant burners has successfully been tested. Application in commercial cooking systems for the fast food industry is also under development.

We claim:

1. Burner membrane for a radiant burner comprising a porous sintered web or inorganic fibers that are resistant to high temperatures, wherein at least the membrane surface opposite from the fuel supply side is provided with intersecting grooves in the shape of a grid such that said grooves bound meshes of the grid to establish a surface area of each said bounded mesh of at least 20 $mm^2$, and wherein said intersecting grooves form a barrier against crack propagation between said bounded mesh surface areas.

2. Burner membrane in accordance with claim 1, wherein the grooves have a depth of less than 1 mm.

3. Burner membrane in accordance with claim 1, wherein the meshes have a nearly equal surface area.

4. Burner membrane in accordance with claim 1, wherein the meshes are regular polygons.

5. Burner membrane in accordance with claim 1, wherein the mesh surface area is between 20 $mm^2$ and 250 $mm^2$.

6. Burner membrane characterised in that the porosity of the membrane is lower in the boundary zones of the grooves than outside these boundary zones.

7. Burner membrane in accordance with claim 1, wherein the inorganic fibers are aluminium and chromium containing metal fibers.

8. Burner membrane in accordance with claim 1, having an average porosity of between 70% and 90%.

9. Burner membrane in accordance with claim 8, wherein the average porosity is between 77% and 85%.

10. Burner membrane in accordance with claim 1, having permeability variation over its entire surface of less than 25%.

11. Burner membrane in accordance with claim 10, wherein the permeability variation is less than 10%.

12. Burner membrane in accordance with claim 1 having a thickness of between 2 and 5 mm.

13. Burner membrane in accordance with claim 1 wherein the membrane has been oxidized prior to its use for radiant combustion.

14. Burner membrane in accordance with claim 1 having a membrane wall in the shape of a cylinder, wherein the concave side of the membrane wall is provided with said grooves which follow the generatrices of the cylinder.

15. Burner membrane having radiation and fuel supply sides and comprises of a laminated structure comprising a layer which includes a sintered web of inorganic fibers according to claim 1 at said radiation side, and a supporting layer which includes a sintered web of stainless steel fibers at said fuel supply side.

16. Burner membrane according to claim 15 wherein the thickness of said sintered web layer of inorganic fibers is less than 2.5 mm.

17. A process for radiant heating with efficiency of articles disposed in front of the radiation side of a burner membrane according to claim 1 wherein the fuel gas supply mixture or the air component thereof is preheated prior to passing through the burner membrane.

18. A process according to claim 17 wherein the preheating temperature is between about 200° C. and 300° C.

19. A radiant surface combustion burner comprising:

a housing with inlet means for the supply of a fuel gas mixture and outlet means for the gas mixture to be burned, and a porous burner membrane which closes said outlet means of the burner housing, wherein said porous burner membrane includes a porous sintered web of inorganic fibers that are resistant to high temperatures, wherein at least the membrane surface opposite from the fuel supply side is provided with intersecting grooves in the shape of a grid such that said grooves bound meshes of the grid to establish a surface area of each said bounded mesh of at least 20 $mm^2$, and wherein said intersecting grooves form a barrier against crack propagation between said bounded mesh surface areas.

20. Burner according to claim 15, wherein the stainless steel fibers are AISI 430 fibers.

21. Burner according to claim 20, wherein the thickness of said sintered web of inorganic fibers is less than 2.5 mm.

22. A burner membrane for a radiant burner comprising:

a porous sintered web of high temperature resistant inorganic fibers;

at least one surface of said burner membrane surface including a grid-like array of intersecting grooves formed in said at leas tone surface to thereby establish individual waffles which are bounded and separated one from another by means of said grid-like array of intersecting grooves;

said grooves also including an adjacent zone of compressed inorganic fibers in said web having a lesser porosity as compared to the sintered web of inorganic fibers outside said zone;

said grooves and adjacent zones of compressed inorganic fibers collectively establishing the means forming a barrier against crack propagation from one said waffle to another.

23. A burner membrane as in claim 22, wherein each said waffle of said burner membrane has a surface area of at least 20 $mm^2$.

24. A burner membrane as in claim 23, wherein each said waffle of said burner membrane has a surface area of between 20 $mm^2$ and 400 $m^2$.

25. A burner membrane as in claim 22, having an average porosity of between 70% and 90%.

26. A burner membrane as in claim 1, wherein said mesh surface area is no greater than 400 $mm^2$.

* * * * *